US010253397B2

(12) United States Patent
Kimura et al.

(10) Patent No.: US 10,253,397 B2
(45) Date of Patent: Apr. 9, 2019

(54) PEARLITIC RAIL AND METHOD FOR MANUFACTURING PEARLITIC RAIL

(71) Applicant: JFE STEEL CORPORATION, Chiyoda-ku, Tokyo (JP)

(72) Inventors: Tatsumi Kimura, Tokyo (JP); Kiyoshi Uwai, Tokyo (JP); Shigeru Endo, Tokyo (JP); Moriyasu Yamaguchi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 548 days.

(21) Appl. No.: 14/779,755

(22) PCT Filed: Mar. 25, 2014

(86) PCT No.: PCT/JP2014/058367

§ 371 (c)(1),
(2) Date: Sep. 24, 2015

(87) PCT Pub. No.: WO2014/157252

PCT Pub. Date: Oct. 2, 2014

(65) Prior Publication Data

US 2016/0083820 A1 Mar. 24, 2016

(30) Foreign Application Priority Data

Mar. 27, 2013 (JP) ..... 2013-067168

(51) Int. Cl.

| | |
|---|---|
| ***C21D 9/04*** | (2006.01) |
| ***C22C 38/28*** | (2006.01) |
| ***C21D 8/00*** | (2006.01) |
| ***C22C 38/00*** | (2006.01) |
| ***C22C 38/18*** | (2006.01) |
| ***C22C 38/50*** | (2006.01) |
| ***C21D 6/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/24*** | (2006.01) |
| ***C22C 38/26*** | (2006.01) |

(52) U.S. Cl.

CPC ..... *C22C 38/28* (2013.01); *C21D 6/001* (2013.01); *C21D 6/002* (2013.01); *C21D 6/005* (2013.01); *C21D 6/008* (2013.01); *C21D 8/00* (2013.01); *C21D 8/005* (2013.01); *C21D 9/04* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/24* (2013.01); *C22C 38/26* (2013.01); *C22C 38/50* (2013.01); *C21D 2211/009* (2013.01)

(58) Field of Classification Search

CPC ..... C21D 8/005; C21D 9/04; C21D 6/001; C21D 6/002; C21D 6/005; C21D 6/008

See application file for complete search history.

(56) References Cited

U.S. PATENT DOCUMENTS

| | | | | |
|---|---|---|---|---|
| 7,955,445 | B2 | 6/2011 | Honjo | |
| 8,210,019 | B2 | 7/2012 | Ueda | |
| 8,980,019 | B2 | 3/2015 | Ueda | |
| 2004/0187981 | A1* | 9/2004 | Ueda | C21D 9/04 148/584 |
| 2010/0116381 | A1 | 5/2010 | Honjo | |
| 2010/0186857 | A1 | 7/2010 | Honjo | |
| 2013/0065079 | A1 | 3/2013 | Ueda | |

FOREIGN PATENT DOCUMENTS

| | | |
|---|---|---|
| CN | 1793402 | 6/2006 |
| CN | 101646795 | 2/2010 |
| CN | 101818312 | 9/2010 |
| EP | 2135966 | 12/2009 |
| EP | 2196552 | 6/2010 |
| JP | 3078461 | 8/2000 |
| JP | 3081116 | 8/2000 |
| JP | 3513427 | 3/2004 |
| JP | 2005171327 | 6/2005 |
| JP | 3731934 | 1/2006 |
| JP | 2008050687 | 3/2008 |

(Continued)

OTHER PUBLICATIONS

CN Office Action for Application No. 201480018025.2, dated May 3, 2016, with partial translation (12 pages).

Japanese Office Action dated Sep. 15, 2015 for Japanese Application No. 2015-508564, including English translation.

Extended European Search Report for European Application No. 14774063.3, dated Nov. 18, 2016, 7 pages.

(Continued)

*Primary Examiner* — Jessee R Roe

(74) *Attorney, Agent, or Firm* — RatnerPrestia

(57) ABSTRACT

A pearlitic rail includes a composition including in % by mass: 0.70% to 0.90% of C; 0.1% to 1.5% of Si; 0.01% to 1.5% of Mn; 0.001% to 0.035% of P; 0.0005% to 0.030% of S; 0.1% to 2.0% of Cr, remainder of the composition consisting of Fe and inevitable impurities. Surface hardness of a rail top is not less than HB 430, and hardness at a depth of 25 mm from a surface of the rail top is not less than HB 410.

8 Claims, 1 Drawing Sheet

(56) References Cited

FOREIGN PATENT DOCUMENTS

| | | |
|---|---|---|
| JP | 4214044 | 1/2009 |
| JP | 2009108396 | 5/2009 |
| JP | 2009108397 | 5/2009 |
| JP | 4272385 | 6/2009 |
| JP | 4355200 | 10/2009 |
| JP | 2009235515 | 10/2009 |
| JP | 2009263753 | 11/2009 |
| JP | 4390004 | 12/2009 |
| JP | 2010077481 | 4/2010 |
| JP | 2010180443 | 8/2010 |
| JP | 2010255046 | 11/2010 |
| WO | 2011155481 | 12/2011 |

OTHER PUBLICATIONS

International Search Report dated Jun. 24, 2014 for International Application No. PCT/JP2014/058367.

* cited by examiner

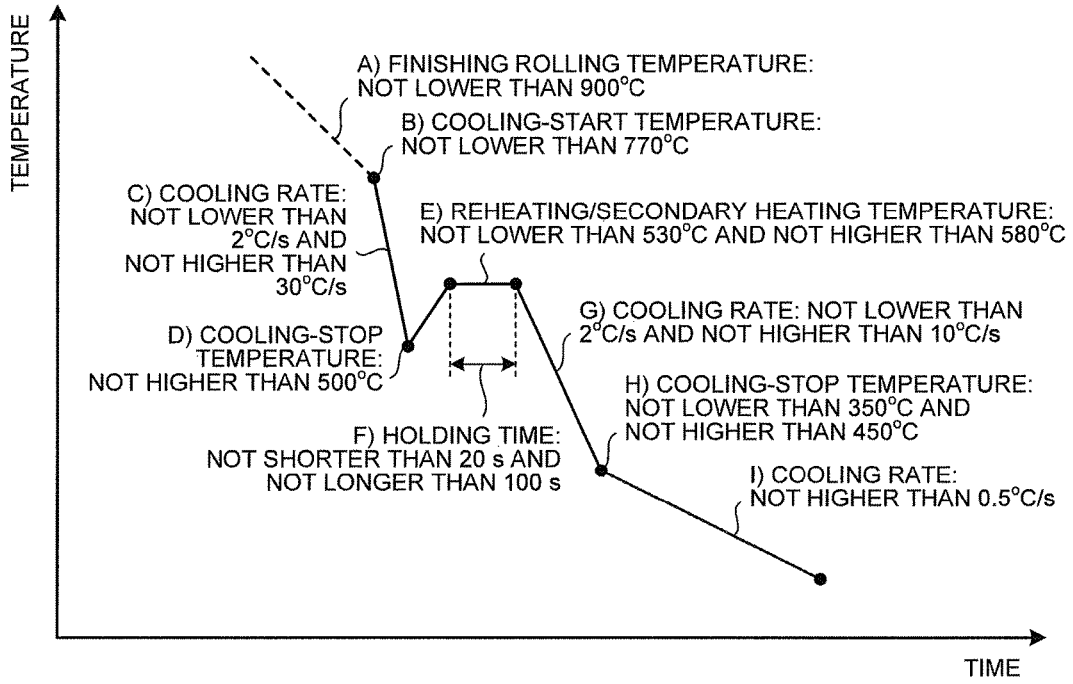
TEMPERATURE
A) FINISHING ROLLING TEMPERATURE:
NOT LOWER THAN 900°C
B) COOLING-START TEMPERATURE:
NOT LOWER THAN 770°C
C) COOLING RATE:
NOT LOWER THAN
2°C/s AND
NOT HIGHER THAN
30°C/s
E) REHEATING/SECONDARY HEATING TEMPERATURE:
NOT LOWER THAN 530°C AND NOT HIGHER THAN 580°C
G) COOLING RATE: NOT LOWER THAN
2°C/s AND NOT HIGHER THAN 10°C/s
D) COOLING-STOP
TEMPERATURE:
NOT HIGHER THAN 500°C
H) COOLING-STOP TEMPERATURE:
NOT LOWER THAN 350°C AND
NOT HIGHER THAN 450°C
F) HOLDING TIME:
NOT SHORTER THAN 20 s AND
NOT LONGER THAN 100 s
I) COOLING RATE:
NOT HIGHER THAN 0.5°C/s
TIME

PEARLITIC RAIL AND METHOD FOR MANUFACTURING PEARLITIC RAIL

CROSS REFERENCE TO RELATED APPLICATIONS

This is the U.S. National Phase application of PCT International Application No. PCT/JP2014/058367, filed Mar. 25, 2014, and claims priority to Japanese Patent Application No. 2013-067168, filed Mar. 27, 2013, the disclosures of each of these applications being incorporated herein by reference in their entireties for all purposes.

FIELD OF THE INVENTION

The present invention relates to a pearlitic rail and a method for manufacturing a pearlitic rail.

BACKGROUND OF THE INVENTION

In freight transportation and mining railways, the loading weight is heavier than the loading weight on passenger coaches, and therefore the load applied to the axle shafts of freight cars is high and the environments at the areas of contact between rails and wheels are very rigorous. For use under such environments, rails are required to be wear resistant and steel having a pearlite structure is conventionally used. In recent years, freight and mineral loading weight is further increasing so as to enhance efficiency in rail transport, and therefore wear of rails is becoming more serious and the service lives of rails before replacement are decreasing. Because of this, improvement in the wear resistance of rails is demanded so as to enhance the service lives of rails before replacement. In addition to this, improvement in damage resistance is important, and a high level of ductility and a high level of toughness are also demanded.

Conventionally, many hard rails having improved rail hardness are developed. For example, Patent Literatures 1, 2, 3, and 4 disclose a hyper-eutectoid rail with an increased cementite content and a method for manufacturing the same. Patent Literatures 5, 6, 7, and 8 disclose a rail having a finer interlamellar spacing in a pearlite structure of eutectoid carbon steel so as to increase hardness.

In addition, many techniques are developed to increase hardness of rails by controlling conditions in manufacturing, such as rolling conditions and cooling conditions. For example, Patent Literature 8 discloses a technique that employs a cooling rate of 1° C./s to 10° C./s for the surface of a rail top starting at a temperature of equal to or more than Ar1 until pearlitic transformation occurs on the surfaces of the rail top and rail top lateral sides and then proceeds into a region at a depth of up to 5 mm from the surface, and then employs a cooling rate of 2° C./s to 20° C./s for the surface of the rail top until pearlitic transformation is completed in a region at a depth of 20 mm or greater from the surface.

Patent Literature 9 discloses a technique that carries out finishing rolling at a temperature of the surface of a rail top within the range of equal to or less than 900° C. and equal to or more than an Ar3 transformation point or an Arcm transformation point to achieve a cumulative surface area reduction rate of the rail top of equal to or more than 20% and a reaction force ratio of equal to or more than 1.25, and then subjects the surface of the rail top that has been subjected to finishing rolling to accelerated cooling or natural cooling at a cooling rate of 2° C./s to 30° C./s to a temperature of at least 550° C. Patent Literature 9 also discloses a rail having internal hardness at a depth of 2 mm from the surface of a rail top of HV 350 to HV 485 (HB 331 to HB 451), excellent ductility, and excellent wear resistance.

Patent Literatures 10, 11, and 12 disclose a technique to subject a rail top that has been subjected to finishing rolling to accelerated cooling and then, after raising the temperature and holding the temperature, perform another round of accelerated cooling.

PATENT LITERATURE

Patent Literature 1: Japanese Patent No. 4272385

Patent Literature 2: Japanese Patent No. 3078461

Patent Literature 3: Japanese Patent No. 3081116

Patent Literature 4: Japanese Patent No. 3513427

Patent Literature 5: Japanese Patent No. 4390004

Patent Literature 6: Japanese Patent Application Laid-open No. 2009-108396

Patent Literature 7: Japanese Patent Application Laid-open No. 2009-235515

Patent Literature 8: Japanese Patent No. 3731934

Patent Literature 9: Japanese Patent Application Laid-open No. 2008-50687

Patent Literature 10: Japanese Patent No. 4355200

Patent Literature 11: Japanese Patent No. 4214044

Patent Literature 12: Japanese Patent Application Laid-open No. 2010-255046

SUMMARY OF THE INVENTION

Although the techniques disclosed in Patent Literature 1 to Patent Literature 12 give high hardness of a surface layer part of the rail top, these techniques sometimes fail to achieve sufficiently high hardness in the interior below the surface layer. In addition, the technique disclosed in Patent Literature 8 gives hardness of HV 391 or higher (HB 370 or higher in terms of Brinell hardness) on the surface and of HV 382 or higher (HB 362 or higher) at 20 mm below the top, which is insufficient from the viewpoint of wear resistance.

The present invention is devised to solve these problems, and an object of the present invention is to provide a pearlitic rail in which hardness from the surface to the interior of the rail top can be increased and wear resistance is improved and a method for manufacturing such a pearlitic rail.

The inventors of the present invention conducted intensive research to solve these problems and, as a result, found that part of platy cementite compounds constituting fine pearlite lamellae undergoes partial spheroidization depending on the conditions during cooling after transformation and this affects internal hardness. Hence, they have found the followings.

To solve the above-described problem and achieve the object, a pearlitic rail according to the present invention includes a composition including in % by mass: 0.70% to 0.90% of C; 0.1% to 1.5% of Si; 0.01% to 1.5% of Mn; 0.001% to 0.035% of P; 0.0005% to 0.030% of S; 0.1% to 2.0% of Cr, remainder of the composition consisting of Fe and inevitable impurities, and surface hardness of a rail top is not less than HB 430, and hardness at a depth of 25 mm from a surface of the rail top is not less than HB 410.

It is preferable that the composition further includes in % by mass at least one of: not more than 0.15% of V; not more than 0.030% of Nb; not more than 1.0% of Cu; not more than 0.5% of Ni; and not more than 0.5% of Mo, remainder of the composition consisting of Fe and inevitable impurities.

It is preferable that the composition further includes in % by mass one or both of: not more than 0.010% of Ca; and not more than 0.1% of REM, remainder of the composition consisting of Fe and inevitable impurities.

It is preferable that the rail top has a 0.2% yield strength of not less than 1,000 MPa, tensile strength of not less than 1,450 MPa, elongation of not less than 12%, and fracture toughness at room temperature of not less than 40 MPa √m.

To solve the above-described problem and achieve the object, a method of manufacturing a pearlitic rail according to the present invention includes: hot rolling a billet having a composition including in % by mass: 0.70% to 0.90% of C; 0.1% to 1.5% of Si; 0.01% to 1.5% of Mn; 0.001% to 0.035% of P; 0.0005% to 0.030% of S; 0.1% to 2.0% of Cr, remainder of the composition consisting of Fe and inevitable impurities, so as to achieve a finishing rolling temperature of not lower than 900° C. to form a rail material; and cooling the rail material in an accelerated manner at a cooling rate of 2° C./s to 30° C./s from a temperature of 770° C. to 500° C., reheating the resultant or subjecting the resultant to secondary heating to a temperature within a range of 530° C. to 580° C., holding the resultant at a temperature range for 20 s to 100 s, and cooling the resultant in an accelerated manner at a cooling rate of 2° C./s to 10° C./s to a temperature within a range of not higher than 450° C.

It is preferable that the composition of the billet further includes in % by mass at least one of: not more than 0.15% of V; not more than 0.030% of Nb; not more than 1.0% of Cu; not more than 0.5% of Ni; and not more than 0.5% of Mo.

It is preferable that the composition of the billet further includes in % by mass one or both of: not more than 0.010% of Ca; and not more than 0.1% of REM.

It is preferable to further include terminating the accelerated cooling performed at a cooling rate of 2° C./s to 10° C./s, at a temperature within a range of 350° C. to 450° C., and then slowly cooling the resultant at a cooling rate of not more than 0.5° C./s.

According to the present invention, a hard pearlitic rail having increased hardness from the surface to the interior of the rail top and having excellent wear resistance can be provided.

BRIEF DESCRIPTION OF THE DRAWING

FIG. 1 is a view that illustrates a pattern of rolling and cooling in an embodiment of a method of the present invention.

DETAILED DESCRIPTION OF EMBODIMENTS OF THE INVENTION

A pearlitic rail and a method for manufacturing a pearlitic rail of embodiments of the present invention are explained below in detail, in terms of the composition of the pearlitic rail, the surface hardness, the internal hardness, the 0.2% yield strength, the tensile strength, the elongation, and the fracture toughness at room temperature of the rail top, and a method for manufacturing a pearlitic rail with the requirements for these items to be satisfied.

First, the composition of the pearlitic rail is explained. In the following explanation, the term "%" referring to the content of each constituent element of the rail means "mass percent (mass %)" unless otherwise indicated.

(Content of C)

The content of C (carbon) is within the range of equal to or more than 0.70% and equal to or less than 0.90%. C is an important element to give cementite formation, increase the hardness and the strength, and improve the wear resistance of a pearlitic rail. These effects are exerted poorly when the content of C is lower than 0.70%, and therefore the lower limit to the content of C is 0.70%. On the other hand, an increase in the content of C means an increase in the content of cementite, leading to a decrease in ductility even though hardness and strength are expected to increase. In addition, an increase in the content of C broadens the range of the γ+θ temperature, which promotes softening of the portion affected by welding heat. With these adverse influences being taken into consideration, the upper limit to the content of C is 0.90%. Preferably, the content of C is within the range of equal to or more than 0.73% and equal to or less than 0.87%.

(Content of Si)

The content of Si (silicon) is within the range of equal to or more than 0.1% and equal to or less than 1.5%. Si is added to a rail material as a deoxidizing ingredient and for reinforcing a pearlite structure. These effects are exerted poorly when the content of Si is lower than 0.1%, and therefore the lower limit to the content of Si is 0.1%. On the other hand, an increase in the content of Si promotes formation of flaws on the surface of a rail, and therefore the upper limit to the content of Si is 1.5%. Preferably, the content of Si is within the range of equal to or more than 0.2% and equal to or less than 1.3%.

(Content of Mn)

The content of Mn (manganese) is within the range of equal to or more than 0.01% and equal to or less than 1.5%. The element Mn has an effect to lower the temperature at which transformation into pearlite occurs and to reduce interlamellar spacings in pearlite, and is therefore effective in ensuring high hardness down to the interior of a rail. Such an effect is exerted poorly when the content of Mn is lower than 0.01%, and therefore the lower limit to the content of Mn is 0.01%. When Mn is added in an amount higher than 1.5%, however, the equilibrium transformation temperature (TE) of pearlite decreases and martensitic transformation readily occurs. Accordingly, the upper limit to the content of Mn is 1.5%. Preferably, the content of Mn is within the range of equal to or more than 0.3% and equal to or less than 1.3%.

(Content of P)

The content of P (phosphorus) is within the range of equal to or more than 0.001% and equal to or less than 0.035%. When the content of P is higher than 0.035%, toughness and ductility decrease. Accordingly, the upper limit to the content of P is 0.035%. Preferably, the upper limit to the content of P is 0.025%. On the other hand, special refining or the like for reducing the content of P results in an increase in the cost of melting processes, and therefore the lower limit to the content of P is 0.001%.

(Content of S)

The content of S (sulfur) is within the range of equal to or more than 0.0005% and equal to or less than 0.030%. S forms bulky coarse MnS extending in the rolling direction to decrease ductility and toughness, and therefore the upper limit to the content of S is 0.030%. When the content of S is lower than 0.0005%, however, the cost of melting processes significantly increases because a longer time is required for melting processes, for example. Accordingly, the lower limit to the content of S is 0.0005%. Preferably, the content of S is within the range of equal to or more than 0.001% and equal to or less than 0.015%.

(Content of Cr)

The content of Cr (chromium) is within the range of equal to or more than 0.1% and equal to or less than 2.0%. Cr leads to an increase in the equilibrium transformation temperature (TE) of pearlite and contributes to reduction in interlamellar spacings in pearlite to increase hardness and strength. This requires Cr in an amount of equal to or more than 0.1%, and therefore the lower limit to the content of Cr is 0.1%. When Cr is added in an amount higher than 2.0%, however, welding defects occur more often and hardenability increases to facilitate martensite formation. Accordingly, the upper limit to the content of Cr is 2.0%. Preferably, the content of Cr is within the range of equal to or more than 0.2% and equal to or less than 1.5%.

In addition to these constituent elements included in the chemical composition of a billet as explained above, the billet may further contain the following constituent elements, where appropriate.

(Contents of Cu, Ni, Mo, V, and Nb)

As for Cu (copper), Ni (nickel), Mo (molybdenum), V (vanadium), and Nb (niobium), at least one element selected from these is preferably contained in a content explained below.

The content of Cu is equal to or less than 1.0%. The element Cu can achieve higher hardness by solid solution hardening and also has an effect to suppress decarbonization. To expect these effects to be obtained, Cu is preferably added in an amount of equal to or more than 0.01%. When Cu is added in an amount higher than 1.0%, however, surface cracking readily occurs during continuous casting or during rolling, and therefore the upper limit to the content of Cu is 1.0%. Preferably, the content of Cu is within the range of equal to or more than 0.05% and equal to or less than 0.6%.

The content of Ni is equal to or less than 0.5%. The element Ni is effective in increasing toughness and ductility. The element Ni is also effective in suppressing Cu cracking when added with Cu, and therefore is preferably added when Cu is added. To obtain this effect, the content of Ni is preferably equal to or more than 0.01%. When Ni is added in an amount higher than 1.0%, however, hardenability increases and martensite formation is facilitated, and therefore the upper limit to the content of Ni is 1.0%. Preferably, the content of Ni is within the range of equal to or more than 0.05% and equal to or less than 0.6%.

The content of Mo is equal to or less than 0.5%. The element Mo is effective in increasing strength. To obtain the effect, the content of Mo is preferably equal to or more than 0.01%. When Mo is added in an amount higher than 0.5%, however, hardenability increases and, as a result, martensite forms, which greatly decreases toughness and ductility. Accordingly, the upper limit to the content of Mo is 0.5%. Preferably, the content of Mo is within the range of equal to or more than 0.05% and equal to or less than 0.3%.

The content of V is equal to or less than 0.15%. The element V forms VC, VN, or the like as a fine precipitate in ferrite and, through such increased ferrite precipitation, is effective in increasing strength. The element V also serves as a hydrogen-trapping site and therefore can be expected to exhibit an effect Lo suppress delayed fracture. To obtain these effects, V is preferably added in an amount of equal to or more than 0.001%. When V is added in an amount higher than 0.15%, however, these effects reach saturation and the cost of alloying significantly increases. Accordingly, the upper limit to the content of V is 0.15%. Preferably, the content of V is within the range of equal to or more than 0.005% and equal to or less than 0.12%.

The content of Nb is equal to or less than 0.030%. The element Nb increases the non-recrystallization temperature of austenite and, as a result, through introduction of processing distortion into austenite during rolling, is effective in reducing the sizes of the pearlite colonies and blocks, thereby being effective in increasing ductility and toughness. To expect these effects to be obtained, Nb is preferably added in an amount of equal to or more than 0.001%. When Nb is added in an amount higher than 0.030%, however, Nb carbonitride is crystallized during the process of solidification to compromise cleanliness, and therefore the upper limit to the content of Nb is 0.030%. Preferably, the content of Nb is within the range of equal to or more than 0.003% and equal to or less than 0.025%.

(Contents of Ca and REM)

As for Ca (calcium) and REM (rare earth metal), at least one element selected from these is preferably contained in a content explained below. Ca and REM are bonded to O (oxygen) and S in steel at the time of solidification to form oxysulfide granules to increase ductility and toughness and improve delayed fracture properties. To expect these effects to be obtained, Ca in an amount of equal to or more than 0.0005% and/or REM in an amount of equal to or more than 0.005% is preferably added.

When an excess amount of Ca and/or REM is added, however, cleanliness is compromised. Accordingly, when Ca and/or REM is added, the content of Ca is equal to or less than 0.010% and the content of REM is equal to or less than 0.1%. Preferably, the content of Ca is within the range of equal to or more than 0.0010% and equal to or less than 0.0070%, and the content of REM is within the range of equal to or more than 0.008% and equal to or less than 0.05%.

The remainder, or components other than those explained above regarding their contents, is made up of Fe (iron) and inevitable impurities. As long as the effects of the present invention are not impaired, contents of components other than those mentioned above is not excluded. N (nitrogen) may be contained in an amount of equal to or less than 0.015%, and O may be contained in an amount of equal to or less than 0.004%. AlN and TiN compromise rolling contact fatigue properties, and therefore the content of Al (aluminum) is desirably equal to or less than 0.003% and the content of Ti (titanium) is desirably equal to or less than 0.003%.

Next, the surface hardness, the internal hardness, the 0.2% yield strength, the tensile strength, the elongation, and the fracture toughness at room temperature of the rail top of the pearlitic rail according to the present invention are explained.

(Surface Hardness of Rail Top, and Internal Hardness at Depth of 25 mm from Surface of Rail Top)

The surface hardness of the rail top is equal to or more than HB 430, and the internal hardness at a depth of 25 mm from the surface of the rail top is equal to or more than HB 410. When the surface hardness of the rail top is lower than HB 430 or the internal hardness at a depth of 25 mm from the surface of the rail top is lower than HB 410, the resulting wear resistance is not sufficiently high.

(0.2% Yield Strength, Tensile Strength, Elongation, and Fracture Toughness at Room Temperature of Rail Top)

Requirements for the tensile properties of the rail top are preferably satisfied, namely, a 0.2% yield strength (YS) of equal to or more than 1,000 MPa, tensile strength (TS) of equal to or more than 1,450 MPa, elongation (EL) of equal to or more than 12%, and fracture toughness at room temperature of equal to or more than 40 MPa $\sqrt{m}$. When the 0.2% yield strength (YS) is equal to or more than 1,000 MPa, the elongation (EL) is equal to or more than 12%, and the fracture toughness at room temperature is equal to or more than 40 MPa √m, a high level of damage resistance of the rail can be ensured. When the tensile strength (TS) is equal to or more than 1,450 MPa, a high level of wear resistance can be ensured.

Next, an embodiment of a method for manufacturing a hard pearlitic rail according to the present invention from steel having the composition described above is explained. FIG. 1 is a view that illustrates a pattern of rolling and cooling in this method.

In this method, as listed in FIG. 1, a billet having the composition described above is subjected to hot rolling so as to achieve a finishing rolling temperature of equal to or more than 900° C. to form a rail material (A). The billet is formed into a rail material, for example, by hot rolling through ordinary groove rolling or universal rolling. The billet is desirably obtained by continuous casting of molten steel that has a composition controlled through melting processes such as a process in a blast furnace, hot-metal pretreatment, a process in a steel converter, and RH degassing.

The finishing rolling temperature of equal to or more than 900° C. means that rolling is carried out within the recrystallization region of austenite. The temperature of equal to or less than 900° C. constitutes a partial recrystallization region or a non-recrystallization region where rolling results in introduction of processing distortion into austenite, which facilitates pearlitic transformation to increase interlamellar spacings in pearlite, leading to a significant decrease in hardness, mainly in internal hardness. Therefore, the finishing rolling temperature is equal to or more than 900° C. The upper limit thereto is not particularly specified. However, when rolling is completed at a temperature higher than 1,000° C., toughness and ductility decrease, and therefore the finishing rolling temperature is preferably equal to or less than 1,000° C.

Subsequently, as listed in FIG. 1, accelerated cooling of the rail material thus formed is initiated at a temperature of equal to or more than 770° C. (cooling-start temperature) at a cooling rate of equal to or more than 2° C./s and equal to or less than 30° C./s to a temperature of equal to or less than 500° C. (cooling-stop temperature) (B→C→D).

After rolling, the accelerated cooling of the surface of the rail top needs to be initiated at equal to or more than 770° C. When the accelerated cooling is initiated at lower than 770° C., the difference between the temperature at the surface layer of the rail top and the internal temperature at a depth of 25 mm from the surface of the rail top is small, and pearlitic transformation starts on the surface of the rail top to produce transformation heat that decreases a cooling rate in the interior, resulting in rendering an internal lamellar structure bulky and coarse and decreasing internal hardness. Accordingly, the cooling-start temperature needs to be equal to or more than 770° C. The cooling-start temperature is preferably equal to or more than 800° C. The upper limit thereto is not particularly specified. However, as the finishing rolling temperature is equal to or more than 900° C., the cooling-start temperature may be equal to or less than 900° C.

The cooling rate during the accelerated cooling is within the range of equal to or more than 2° C./s and equal to or less than 30° C./s. When the cooling rate is lower than 2° C./s, supercooling cannot be ensured to occur and the surface hardness of the rail top decreases. When the cooling rate is higher than 30° C./s, however, bainite and martensite that have disadvantageous effects on wear resistance readily form. Preferably, the cooling rate is within the range of equal to or more than 2.0° C./s and equal to or less than 10° C./s.

In order to allow pearlitic transformation on the surface of the rail top to thoroughly complete, the cooling needs to be continued to a temperature of equal to or less than 500° C. Accordingly, the cooling-stop temperature of the accelerated cooling here is equal to or less than 500° C. This is because, when the cooling-stop temperature is higher than 500° C., the surface of the rail top softens. When cooling at a cooling rate of equal to or more than 2.0° C./s and equal to or less than 10° C./s is continued to a temperature within the range of equal to or less than 200° C., however, martensite forms. Accordingly, the cooling-stop temperature is preferably equal to or more than 200° C.

Subsequently, as listed in FIG. 1, the resultant is reheated or subjected to secondary heating to a temperature within the range of equal to or more than 530° C. and equal to or less than 580° C. (reheating/secondary heating temperature), held at the temperature range for equal to or longer than 20 s and equal to or shorter than 100 s (holding time), and then cooled in an accelerated manner at a cooling rate of equal to or more than 2° C./s and equal to or less than 10° C./s to a temperature within the range of equal to or less than 450° C., preferably equal to or more than 350° C. and equal to or less than 450° C. (cooling-stop temperature) (E→F→G→H).

In order to allow pearlitic transformation to proceed successively from the surface to a depth of 25 mm of the rail top after the surface of the rail top has been cooled in such an accelerated manner to a temperature of equal to or less than 500° C., the reheating or the secondary heating needs to be continued to a temperature within the range of equal to or more than 530° C. and equal to or less than 580° C. In other words, a reheating/secondary heating temperature of lower than 530° C. potentially leads to bainitic transformation, and therefore the lower limit to the reheating/secondary heating temperature is 530° C. On the other hand, in order to ensure supercooling to occur to achieve a fine interior pearlite structure, the upper limit to the reheating/secondary heating temperature is 580° C. This is because, when the reheating or the secondary heating is continued to a temperature higher than 580° C., internal hardness decreases.

In raising the temperature to the range of equal to or more than 530° C. and equal to or less than 580° C., which is the reheating/secondary heating temperature, heat retained inside the rail top or heat due to transformation heat released when pearlitic transformation successively proceeds from the surface to the interior of the rail top may be used, or forced heating may be performed using an external heat source (with a gas burner, through induction heating, or the like).

The time for which the resultant is held at a temperature within the range of equal to or more than 530° C. and equal to or less than 580° C., which is the reheating/secondary heating temperature, needs to be equal to or longer than 20 s. When the holding time is shorter than 20 s, insufficient pearlitic transformation proceeds mainly at the surface layer of the rail top. When the holding time is longer than 100 s, however, part of platy cementite compounds obtained after pearlitic transformation spheroidizes to decrease internal hardness in particular. Accordingly, the holding time is within the range of equal to or longer than 20 s and equal to or shorter than 100 s.

After a holding time of equal to or longer than 20 s and equal to or shorter than 100 s has passed, accelerated cooling needs to be performed immediately. The cooling rate of the accelerated cooling here is within the range of equal to or more than 2° C./s and equal to or less than 10° C./s. This is particularly important in this method in order to prevent decomposition of platy cementite compounds formed by pearlitic transformation into spheroids. When the cooling rate is lower than 2° C./s, spheroidization of cementite is not sufficiently suppressed, while when the cooling rate is higher than 10° C./s, bending, warpage, and/or the like occurs to a great extent.

The accelerated cooling here needs to be continued to a temperature of equal to or less than 450° C. This is because, when the cooling-stop temperature is higher than 450° C., part of the platy cementite compounds spheroidizes and softens. When the accelerated cooling is continued to a temperature of lower than 350° C., however, hydrogen is left in the interior of steel, which may give rise to the risk of delayed fracture, and therefore the accelerated cooling is preferably terminated at a temperature of equal to or more than 350° C. Accordingly, the cooling-stop temperature for the accelerated cooling here is within the range of equal to or less than 450° C. and is preferably within the range of equal to or more than 350° C. and equal to or less than 450° C.

After the accelerated cooling is terminated at a temperature within the range of equal to or more than 350° C. and equal to or less than 450° C., slow cooling is preferably performed at a cooling rate of equal to or less than 0.5° C./s (I), as listed in FIG. 1.

This is because, after the accelerated cooling to a temperature within the range of equal to or more than 350° C. and equal to or less than 450° C. is performed so as to suppress spheroidization of cementite, it is preferable to release hydrogen from the interior of steel. When the cooling rate is higher than 0.5° C./s after the termination of the accelerated cooling, the risk of hydrogen left in the interior of steel causing delayed fracture cannot be completely avoided. Therefore, the cooling rate here is preferably equal to or less than 0.5° C./s. Similar risks increase when the slow cooling is terminated at a temperature higher than 200° C., and therefore the slow cooling is desirably continued to a temperature of equal to or less than 200° C.

By the method thus explained, a hard pearlitic rail having high hardness (high strength), excellent toughness, and excellent ductility can be obtained and, more specifically, the pearlitic rail of the present invention having hardness, namely, surface hardness of the rail top of equal to or more than HB 430 and 25-mm internal hardness of equal to or more than HB 410 can be obtained. The reason why the surface hardness of the rail top and the 25-mm internal hardness of the rail top (hardness at a depth of 25 mm from the surface of the rail top) of the pearlitic rail according to the present invention are preferably equal to or more than HB 430 and preferably equal to or more than HB 410, respectively, is that these values need to be satisfied so as to obtain sufficiently high wear resistance. By the method of the present invention thus explained, a hard pearlitic rail that satisfies requirements for tensile properties, namely, a 0.2% yield strength (YS) of equal to or more than 1,000 MPa, tensile strength (TS) of equal to or more than 1,450 MPa, elongation (EL) of equal to or more than 12%, and fracture toughness at room temperature of equal to or more than 40 MPa √m can be obtained. When the 0.2% yield strength (YS) is equal to or more than 1,000 MPa and the elongation (EL) is equal to or more than 12%, a high level of damage resistance of the rail can be ensured. When the tensile strength (TS) is equal to or more than 1,450 MPa, a high level of wear resistance can be ensured.

In particular, the reason why the method gives high hardness, namely, surface hardness of the rail top of equal to or more than HB 430 and 25-mm internal hardness of equal to or more than HB 410 is that, by employing a specific holding time for reheating/secondary heating during which pearlitic transformation is allowed to proceed and specific conditions during cooling after reheating/secondary heating, spheroidization of cementite is suppressed. The pearlite structure is a layered structure composed of hard cementite and soft ferrite, where the smaller the distance between layers (interlamellar spacing) of this layered structure is, the harder the pearlite structure can be without compromising toughness and ductility. However, after hot rolling of a billet into a rail form, when a relatively high temperature is kept during the cooling process after completion of pearlitic transformation, cementite is converted into a sphere that is thermally more stable, whereby a fine lamellar structure cannot be kept. This phenomenon occurs only when the holding time in the step E in FIG. 1 is longer than 100 s or when the cooling rate in the step G is lower than 2° C./second. Such spheroidization of cementite decreases hardness and strength to a great extent.

As for each of a rail manufactured by the method explained above, a rail manufactured by the method explained above where the holding time in the step E in FIG. 1 was changed to be longer than 100 s, and a rail manufactured by the method explained above where the cooling rate in the step G was changed to be lower than 2° C./second, the inventors of the present invention observed a pearlite structure in a region at a depth of 25 mm from the surface of the rail top and evaluated the degree of spheroidization of cementite. Specifically, observation of a region at a depth of 25 mm from the surface of the rail top was performed for randomly selected 30 fields of view with a scanning electron microscope at a magnification of 20,000 times, and the spherical state of cementite was evaluated using a spheroidization rate (C) calculated by Formula (1).

$$\text{Spheroidization rate } (C) = \text{number of cementite compounds having aspect ratio of lower than 20 } (A)/\text{total number of cementite compounds } (B) \times 100 \quad (1)$$

The results demonstrated that the rail manufactured by the method of the present invention that satisfied internal hardness at a depth of 25 mm from the surface of the rail top of equal to or more than HB 410 had a spheroidization rate (C) of lower than 5%. The results also demonstrated that the rail manufactured with a holding time in the step E of longer than 100 s and the rail manufactured with a cooling rate in the step G of lower than 2° C./second had internal hardness at a depth of 25 mm from the surface of the rail top of lower than HB 410 and a spheroidization rate (C) of equal to or more than 5%. This indicates that, by suppressing spheroidization of cementite, internal hardness increased in a region at a depth of 25 mm from the surface of the rail top.

EXAMPLES

Table 1 lists the chemical compositions (mass percent) of rails of a standard example, inventive examples, and comparative examples taken as samples for this example. In this example, steel having a chemical composition listed in Table 1 was melted, heated, hot rolled, and cooled to give a 136-pound rail or a 141-pound rail. The contents of Al, Ti, N, and O listed in Table 1 refer to the contents of these as inevitable impurities. Table 2 lists conditions for manufacturing the rails of the standard example, the inventive examples, and the comparative examples.

TABLE 1

| Steel | Chemical composition (mass %) | | | | | | | | | | | | | | | | |
|---|---|---|---|---|---|---|---|---|---|---|---|---|---|---|---|---|---|
| | C | Si | Mn | P | S | Cr | Cu | Ni | Mo | V | Nb | Ca | REM | Al | Ti | N | O |
| A | 0.78 | 0.56 | 0.54 | 0.015 | 0.004 | 0.77 | — | — | — | 0.058 | — | — | — | 0.001 | 0.001 | 0.0043 | 0.0015 |
| B | 0.80 | 0.55 | 1.18 | 0.018 | 0.005 | 0.26 | — | — | — | — | 0.011 | — | — | 0.002 | 0.001 | 0.0052 | 0.0021 |
| C | 0.83 | 0.57 | 1.49 | 0.012 | 0.004 | 0.82 | — | — | — | — | — | — | — | 0.001 | 0.002 | 0.0035 | 0.0010 |
| D | 0.78 | 0.26 | 0.81 | 0.02 | 0.005 | — | 0.36 | 0.31 | — | 0.06 | — | — | — | 0.002 | 0.001 | 0.0042 | 0.0015 |
| E | 0.83 | 1.06 | 0.41 | 0.017 | 0.003 | 0.87 | — | — | — | — | — | 0.0022 | — | 0.001 | 0.001 | 0.0039 | 0.0012 |
| F | 0.75 | 0.81 | 0.62 | 0.017 | 0.005 | 0.77 | — | — | 0.12 | — | — | — | 0.008 | 0.003 | 0.001 | 0.0045 | 0.0018 |
| G | 0.68 | 0.63 | 1.26 | 0.015 | 0.005 | 0.76 | — | — | — | 0.042 | — | — | — | 0.002 | 0.002 | 0.0038 | 0.0010 |
| H | 1.05 | 0.55 | 0.31 | 0.016 | 0.005 | 0.54 | — | — | — | — | — | — | — | 0.001 | 0.001 | 0.0053 | 0.0012 |

*The contents of Al, Ti, N, and O refer to the contents of these as inevitable impurities.

TABLE 2

| Steel | Conditions | Finishing rolling temperature (° C.) | Cooling-start temperature (° C.) | Cooling rate (° C./s) | Cooling-stop temperature (° C.) | Reheating/secondary heating temperature (° C.) | Holding time (s) | Cooling rate (° C./s) | Cooling-stop temperature (° C.) | Cooling rate (° C./s) | Remarks |
|---|---|---|---|---|---|---|---|---|---|---|---|
| A | A1 | 920 | 730 | 4.8 | 450 | 550 | 30 | 2.5 | 380 | 0.4 | Standard Example |
| A | A2 | 920 | 800 | 5 | 450 | 550 | 30 | 2.5 | 380 | 0.4 | Inventive Example |
| A | A3 | 950 | 830 | 7 | 430 | 530 | 30 | 5 | 350 | 0.4 | Inventive Example |
| A | A4 | 940 | 820 | 5 | 440 | 560 | 20 | 4 | 300 | 0.4 | Inventive Example |
| A | A5 | 920 | 730 | 4.8 | 450 | 550 | 30 | 2.5 | 380 | 0.4 | Comparative Example |
| A | A6 | 930 | 790 | 1 | 450 | 530 | 20 | 2 | 390 | 0.4 | Comparative Example |
| A | A7 | 950 | 820 | 40 | 390 | 550 | 60 | 2.5 | 380 | 0.4 | Comparative Example |
| A | A8 | 920 | 800 | 5 | 550 | 590 | 30 | 3 | 400 | 0.4 | Comparative Example |
| A | A9 | 900 | 810 | 6 | 400 | 510 | 20 | 1.8 | 380 | 0.4 | Comparative Example |
| A | A10 | 950 | 840 | 5 | 460 | 540 | 150 | 2.5 | 380 | 0.4 | Comparative Example |
| A | A11 | 920 | 800 | 5 | 450 | 540 | 10 | 2.5 | 400 | 0.4 | Comparative Example |
| A | A12 | 930 | 800 | 5 | 480 | 550 | 40 | 0.4 | 380 | 0.4 | Comparative Example |
| A | A13 | 950 | 820 | 5 | 450 | 570 | 40 | 2.5 | 270 | 0.4 | Inventive Example |
| A | A14 | 930 | 800 | 4.5 | 480 | 530 | 30 | 3 | 380 | 3 | Inventive Example |
| B | B1 | 930 | 850 | 5 | 450 | 540 | 30 | 3 | 380 | 0.4 | Inventive Example |
| C | C1 | 920 | 800 | 4 | 480 | 570 | 20 | 3 | 380 | 0.4 | Inventive Example |
| D | D1 | 950 | 810 | 5 | 450 | 540 | 30 | 2.5 | 390 | 0.4 | Inventive Example |
| E | E1 | 930 | 820 | 6 | 420 | 550 | 30 | 3 | 400 | 0.4 | Inventive Example |
| F | F1 | 930 | 800 | 5 | 450 | 550 | 30 | 3 | 400 | 0.4 | Inventive Example |
| G | G1 | 930 | 820 | 5 | 470 | 550 | 30 | 2.5 | 400 | 0.4 | Comparative Example |
| H | H1 | 940 | 850 | 5 | 460 | 540 | 30 | 3 | 380 | 0.4 | Comparative Example |

Then, the resulting rails were evaluated for the hardness and the microstructure of the rail tops. The results are listed in Table 3.

TABLE 3

| Steel | Conditions | Top microstructure | Spheroidization of cementite | Surface hardness (HB) | 25-mm Internal hardness (HB) | 0.2% YS (MPa) | TS (MPa) | EI (%) | KIC (MPa√m) | Wear resistance *1 | UT*2 UT defect attributable to hydrogen | Remarks |
|---|---|---|---|---|---|---|---|---|---|---|---|---|
| A | A1 | Pearlite | No | 450 | 383 | 921 | 1370 | 13.8 | 38 | 1.0 | No | Standard Example |
| A | A2 | Pearlite | No | 465 | 410 | 1020 | 1480 | 13.4 | 44 | 0.83 | No | Inventive Example |
| A | A3 | Pearlite | No | 471 | 416 | 1043 | 1493 | 14.2 | 43 | 0.8 | No | Inventive Example |
| A | A4 | Pearlite | No | 462 | 412 | 1053 | 1478 | 13.9 | 44 | 0.82 | No | Inventive Example |
| A | A5 | Pearlite | No | 450 | 383 | 921 | 1370 | 13.8 | 38 | 1.26 | No | Comparati Example |
| A | A6 | Pearlite | No | 410 | 372 | 821 | 1212 | 14.3 | 37 | 1.12 | No | Comparative Example |
| A | A7 | Partially bainite | No | 473 | 426 | 938 | 1460 | 12.8 | 40 | 1.26 | No | Comparative Example |
| A | A8 | Pearlite | No | 428 | 382 | 916 | 1397 | 12.6 | 38 | 1.08 | No | Comparative Example |
| A | A9 | Partially bainite | Yes | 431 | 380 | 900 | 1376 | 12.3 | 38 | 1.26 | No | Comparative Example |
| A | A10 | Pearlite | Yes | 433 | 391 | 922 | 1421 | 12.2 | 38 | 1.0 | No | Comparative Example |
| A | A11 | Partially bainite | No | 435 | 386 | 833 | 1385 | 12.6 | 39 | 1.33 | No | Comparative Example |
| A | A12 | Pearlite | Yes | 426 | 371 | 800 | 1312 | 11.3 | 38 | 1.12 | No | Comparative Example |
| A | A13 | Pearlite | No | 458 | 415 | 1026 | 1453 | 12.8 | 43 | 0.85 | Yes | Inventive Example |
| A | A14 | Pearlite | No | 462 | 412 | 1034 | 1473 | 12.4 | 44 | 0.83 | Yes | Inventive Example |
| B | B1 | Pearlite | No | 450 | 410 | 1033 | 1462 | 12.8 | 44 | 0.85 | No | Inventive Example |

TABLE 3-continued

| Steel | Conditions | Top microstructure | Spheroidization of cementite | Surface hardness (HB) | 25-mm Internal hardness (HB) | 0.2% YS (MPa) | TS (MPa) | EI (%) | KIC (MPa√m) | Wear resistance *1 | UT*2 UT defect attributable to hydrogen | Remarks |
|---|---|---|---|---|---|---|---|---|---|---|---|---|
| C | C1 | Pearlite | No | 448 | 410 | 1024 | 1450 | 13.5 | 45 | 0.86 | No | Inventive Example |
| D | D1 | Pearlite | No | 458 | 418 | 1029 | 1489 | 13.1 | 43 | 0.86 | No | Inventive Example |
| E | E1 | Pearlite | No | 476 | 421 | 1093 | 1526 | 13.8 | 45 | 0.78 | No | Inventive Example |
| F | F1 | Pearlite | No | 433 | 412 | 1000 | 1450 | 13.2 | 46 | 0.86 | No | Inventive Example |
| G | G1 | Pearlite | No | 383 | 352 | 721 | 1275 | 12.8 | 43 | 1.33 | No | Comparative Example |
| H | H1 | Pearlite | No | 451 | 402 | 1006 | 1468 | 8.3 | 35 | 0.84 | No | Comparative Example |

*1: A wear volume of a specimen relative to a wear volume in Standard Example was defined as 1.

*2: Whether UT defect attributable to hydrogen was observed.

The surface hardness of the rail top (surface hardness) was measured after removal of a decarbonized layer with a grinder. The internal hardness at a depth of 25 mm from the surface of the rail top (25-mm internal hardness) measured was the hardness at a depth of 25 mm from the surface of a C section that had been cut out from the rail top and then polished. The microstructure of the rail top was evaluated through microscopic observation of the microstructure of the surface layer and the microstructure at a depth of 25 mm. Subsequently, a scanning electron microscope was used to observe randomly selected 30 fields of view at a magnification of 20,000 times, followed by image processing to determine the aspect ratio (horizontal-to-vertical ratio) of each cementite compound in a pearlite structure, and then the resulting aspect ratio was used to calculate a spheroidization rate (C) defined by Formula (1). A sample having a spheroidization rate (C) of lower than 5% was evaluated as having no cementite spheroidization observed, while a sample having a spheroidization rate (C) of equal to or more than 5% was evaluated as having cementite spheroidization observed. The tensile test was carried out at room temperature in accordance with the AREMA standards for specimen collection. The fracture toughness test was carried out in accordance with ASTMA 399 by KIC at room temperature on a 0.9-inch CT specimen collected from a C section of the rail top. Delayed fracture was evaluated from the presence or absence of enlargement of a defect on the rail top by a UT test. Wear resistance was evaluated by measuring the wear volume of a specimen having an outer diameter of 30 mm and a width of 8 mm, from a region at a depth of 20 mm from the surface of the rail top after eighty thousand rotations on a two-roller wear tester with a contact stress of 1,200 MPa and a specific sliding of—10%, and then determining the ratio of wear volume relative to the standard example. The test was performed in atmospheric air using a mating material having hardness of HB 370.

As listed in Table 3, each of the rails of the inventive examples having a chemical composition within the scope of the present invention and manufactured under conditions within the scope of the present invention had a pearlite structure at the rail top and had high hardness, namely, surface hardness of equal to or more than HB 430 and 25-mm internal hardness of equal to or more than HB 410. The rail top of each rail also had a 0.2% yield strength (YS) of equal to or more than 1,000 MPa, tensile strength (TS) of equal to or more than 1,450 MPa, elongation (EL) of equal to or more than 12%, and fracture toughness at room temperature of equal to or more than 40 MPa √m. Thus, each of the rails was evaluated as excellent.

In contrast to this, the rails of the standard example and the comparative examples having a chemical composition outside the preferred scope of the present invention and manufactured under conditions outside the preferred scope of the present invention had bainite formed on part of the rail top and therefore had low wear resistance or had a pearlite structure with low hardness and therefore had low wear resistance, low ductility, and/or low toughness.

As thus explained, according to the present invention, by controlling the chemical composition of a billet and the cooling conditions, spheroidization of platy cementite compounds after pearlitic transformation can be sufficiently suppressed. Accordingly, a rail having high hardness, namely, surface hardness of the rail top of equal to or more than HB 430 and hardness at a depth of 25 mm from the surface of the rail top of equal to or more than HB 410 and excellent wear resistance can be obtained. In addition, a fine pearlite lamellar structure can be obtained throughout the rail top from the surface to the interior of the rail top, and therefore a rail having excellent ductility, excellent fracture toughness, and excellent damage resistance can be obtained. As a result, a pearlitic rail having high hardness from the surface to the interior of the rail top and a method for manufacturing such a pearlitic rail can be stably provided. The rail of the present invention can be suitably used as a rail that is required to be wear resistant mainly for rail transport of heavy freight or the like.

The embodiments of the present invention are explained above. The scope of the present invention, however, is not limited to these embodiments that are described to constitute merely part of the disclosure of present invention. In other words, other embodiments, examples, techniques for operation, and the like developed based on these embodiments by those skilled in the art and the like are also included in the scope of the present invention.

According to the present invention, a hard pearlitic rail having increased hardness from the surface to the interior of the rail top and having excellent wear resistance can be provided.

The invention claimed is:

1. A method of manufacturing a pearlitic rail, the method comprising:

hot rolling a billet having a composition including in % by mass: 0.70% to 0.90% of C; 0.1% to 1.5% of Si; 0.01% to 1.5% of Mn; 0.001% to 0.035% of P; 0.0005% to 0.030% of S; 0.1% to 2.0% of Cr, remainder of the composition consisting of Fe and inevitable impurities, so as to achieve a finishing rolling temperature of not lower than 900° C. to form a rail material; and cooling the rail material in an accelerated manner at a cooling rate of 2° C./s to 30° C./s from a temperature of 770° C. to 500° C., reheating the rail material or subjecting the rail material to secondary heating to a temperature within a range of 530° C. to 580° C., holding the rail material within the range of 530° C. to 580° C. for 20 s to 100 s, and cooling the rail material in an accelerated manner at a cooling rate of 2° C./s to 10° C./s to a temperature within a range of not higher than 450° C.

2. The method of manufacturing a pearlitic rail according to claim 1, further comprising terminating the accelerated cooling performed at a cooling rate of 2° C./s to 10° C./s, at a temperature within a range of 350° C. to 450° C., and then slowly cooling the rail material at a cooling rate of not more than 0.5° C./s.

3. The method of manufacturing a pearlitic rail according to claim 1, wherein the composition of the billet further includes in % by mass one or both of: not more than 0.010% of Ca; and not more than 0.1% of REM.

4. The method of manufacturing a pearlitic rail according to claim 3, further comprising terminating the accelerated cooling performed at a cooling rate of 2° C./s to 10° C./s, at a temperature within a range of 350° C. to 450° C., and then slowly cooling the rail material at a cooling rate of not more than 0.5° C./s.

5. The method of manufacturing a pearlitic rail according to claim 1, wherein the composition of the billet further includes in % by mass at least one of: not more than 0.15% of V; not more than 0.030% of Nb; not more than 1.0% of Cu; not more than 0.5% of Ni; and not more than 0.5% of Mo.

6. The method of manufacturing a pearlitic rail according to claim 5, further comprising terminating the accelerated cooling performed at a cooling rate of 2° C./s to 10° C./s, at a temperature within a range of 350° C. to 450° C., and then slowly cooling the rail material at a cooling rate of not more than 0.5° C./s.

7. The method of manufacturing a pearlitic rail according to claim 5, wherein the composition of the billet further includes in % by mass one or both of: not more than 0.010% of Ca; and not more than 0.1% of REM.

8. The method of manufacturing a pearlitic rail according to claim 7, further comprising terminating the accelerated cooling performed at a cooling rate of 2° C./s to 10° C./s, at a temperature within a range of 350° C. to 450° C., and then slowly cooling the rail material at a cooling rate of not more than 0.5° C./s.

* * * * *